US008271275B2

(12) United States Patent
Goto et al.

(10) Patent No.: US 8,271,275 B2
(45) Date of Patent: Sep. 18, 2012

(54) SCALABLE ENCODING DEVICE, AND SCALABLE ENCODING METHOD

(75) Inventors: Michiyo Goto, Tokyo (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1087 days.

(21) Appl. No.: 11/915,617

(22) PCT Filed: May 29, 2006

(86) PCT No.: PCT/JP2006/310689

§ 371 (c)(1),
(2), (4) Date: Nov. 27, 2007

(87) PCT Pub. No.: WO2006/129615

PCT Pub. Date: Dec. 7, 2006

(65) Prior Publication Data

US 2009/0271184 A1 Oct. 29, 2009

(30) Foreign Application Priority Data

May 31, 2005 (JP) ..... 2005-159685
Nov. 30, 2005 (JP) ..... 2005-346665

(51) Int. Cl.
*G10L 19/12* (2006.01)

(52) U.S. Cl. ..... 704/223; 704/500; 704/222; 704/220; 704/211; 704/205; 704/201; 704/200.1; 704/200; 700/94; 455/403; 386/70; 381/23

(58) Field of Classification Search ..... 704/200.1, 704/220, 223, 500, 222, 211, 205, 201, 200; 455/403; 369/4; 700/94; 386/70; 381/23
See application file for complete search history.

(56) References Cited

U.S. PATENT DOCUMENTS 5,243,686 A * 9/1993 Tokuda et al. ..... 704/200
(Continued)

FOREIGN PATENT DOCUMENTS

WO 0223527 3/2002

OTHER PUBLICATIONS

Kawamoto et al., "Channel-kan Sokan o Mochiita Ta-Channel Shingo no Kagyaku Asshuku Fugoka", FIT 2004 (Dai 3 Kai Forum on Information Technology) Koen Ronbunshu, M-016, Aug. 20, 2004, pp. 123-124.

(Continued)

*Primary Examiner* — Michael Colucci
(74) *Attorney, Agent, or Firm* — Greenblum & Bernstein, P.L.C.

(57) ABSTRACT

A scalable encoding device capable of reducing an encoding rate to reduce a circuit scale while preventing sound quality deterioration of a decoded signal. An extension layer is coarsely divided into a system for processing a first channel and a system for processing a second channel. A sound source predictor for processing the first channel predicts a drive sound source signal of the first channel from a drive sound source signal of a monaural signal, and outputs the predicted drive sound source signal through a multiplier to a first CELP encoder. A sound source predictor for processing the second channel predicts the drive sound source signal of the second channel from the drive sound source signal of the monaural signal and the output from the first CELP encoder, and outputs the predicted drive sound source signal through a multiplier to a second CELP encoder. The first and second CELP encoders perform CELP encoding operations of the individual channels using individual predicted drive sound source signals.

12 Claims, 10 Drawing Sheets

U.S. PATENT DOCUMENTS

| | | | | |
|---|---|---|---|---|
| 5,434,948 | A * | 7/1995 | Holt et al. | 704/220 |
| 5,651,090 | A * | 7/1997 | Moriya et al. | 704/200.1 |
| 5,812,944 | A * | 9/1998 | Matsumoto | 455/403 |
| 5,915,066 | A * | 6/1999 | Katayama | 386/338 |
| 6,052,661 | A * | 4/2000 | Yamaura et al. | 704/222 |
| 6,278,900 | B1 * | 8/2001 | Aihara | 700/94 |
| 7,069,223 | B1 * | 6/2006 | Matsumoto et al. | 704/500 |
| 7,203,638 | B2 * | 4/2007 | Jelinek et al. | 704/201 |
| 7,382,886 | B2 * | 6/2008 | Henn et al. | 381/23 |
| 2003/0115051 | A1 | 6/2003 | Chen et al. | |
| 2004/0044524 | A1 | 3/2004 | Minde et al. | |
| 2004/0049379 | A1 * | 3/2004 | Thumpudi et al. | 704/205 |
| 2005/0149322 | A1 * | 7/2005 | Bruhn et al. | 704/211 |
| 2005/0149323 | A1 | 7/2005 | Chen et al. | |
| 2005/0149324 | A1 | 7/2005 | Chen et al. | |
| 2005/0159947 | A1 | 7/2005 | Chen et al. | |
| 2006/0206319 | A1 * | 9/2006 | Taleb | 704/223 |
| 2007/0253481 | A1 | 11/2007 | Oshikiri et al. | |
| 2007/0271092 | A1 | 11/2007 | Ehara et al. | |
| 2009/0030700 | A1 * | 1/2009 | Liebchen | 704/500 |

OTHER PUBLICATIONS

Yoshida et al., "Scalable Stereo Onsei Fugoka no Channel-kan Yosoku ni Kansuru Yobi Kento", 2005 Nen The Institute of Electronics, Information and Communication Engineers Sogo Taikai Koen Ronbunshuu, D-14-1, Mar. 7, 2005, p. 118.

Goto et al., "Channel-kan Joho o Mochiita Onsei Tsushinyo Stereo Onsei Fugoka Moho no Kento", 2005 Nen The Institute of Electronics, Information and Communication Engineers Sogo Taikai Koen Ronbunshuu, D-14-2, Mar. 7, 2005, p. 119.

ISO/IEC 14496-3: (B. 14 Scalable AAC with core coder), pp. 231-233.

Ramprashad, "Stereophonic CELP coding using cross channel prediction", Proc. IEEE Workshop on Speech Coding, pp. 136-138.

* cited by examiner

SCALABLE ENCODING DEVICE, AND SCALABLE ENCODING METHOD

TECHNICAL FIELD

The present invention relates to a scalable coding apparatus and a scalable coding method for encoding a stereo signal.

BACKGROUND ART

Like a call made using a mobile telephone, with speech communication in a mobile communication system, currently, communication using a monaural scheme (monaural communication) is a major stream. However, hereafter, like a fourth generation mobile communication system, if a transmission rate becomes a still higher bit rate, it is possible to ensure a bandwidth for transmitting a plurality of channels, and therefore it is expected that communication using a stereo scheme (stereo communication) will be also widespread in speech communication.

For example, when it is considered that the current situation where the number of users increases who enjoy stereo music by recording music in a mobile audio player provided with a HDD (hard disc) and attaching earphones or headphones for stereo to the player, in the future, it is expected that mobile telephones and music players will be linked together and a life style will be prevalent where speech communication is carried out using a stereo scheme utilizing equipments such as earphones and headphones for stereo. Further, in an environment such as Video conference that has recently become widespread, in order to enable conversation having high-fidelity, it is expected that stereo communication is performed.

On the other hand, in a mobile communication system and wired communication system, in order to reduce load of the system, it is typical to achieve a low bit rate of transmission information by encoding speech signals to be transmitted in advance. As a result, recently, a technique for encoding stereo speech signals attracts attention. For example, there is a coding technique for increasing the coding efficiency for encoding predictive residual signals to which weight of CELP coding for stereo speech signals is assigned, using cross-channel prediction (refer to non-patent document 1).

Furthermore, even if stereo communication becomes widespread, it is also expected that monaural communication will still be carried out. This is because monaural communication is carried out at a low bit rate and its communication cost is expected to be reduced, and moreover, a mobile telephone supporting only monaural communication has a small circuit and is inexpensive, so that users who do not want high quality speech communication will prefer to purchase a mobile telephone supporting only monaural communication. Therefore, there will be mobile telephones supporting stereo communication and mobile telephones supporting monaural communication in one communication system, and the communication system needs to support both stereo communication and monaural communication. Moreover, in a mobile communication system, communication data is exchanged using radio signals, and therefore, a part of the communication data may be lost depending on a channel environment. Therefore, it will be very useful if a mobile telephone has a function of restoring original communication data from the rest of received data, even when the part of the communication data is lost.

There is scalable coding formed with a stereo signal and a monaural signal as a function of supporting both stereo communication and monaural communication and restoring original communication data from the rest of received data, even when the part of the communication data is lost. As an example of a scalable coding apparatus having this function, there is an apparatus disclosed in Non-Patent Document 2.

Non-Patent Document 1: Ramprashad S. A., "Stereophonic CELP coding using cross channel prediction", Proc. IEEE Workshop on Speech Coding, Pages: 136 to 138, (17 to 20 Sep. 2000)

Non-Patent Document 2: ISO/IEC 14496-3:1999 (B.14 Scalable AAC with core coder)

DISCLOSURE OF INVENTION

Problems to be Solved by the Invention

However, the technique disclosed in Non-Patent Document 1 independently has adaptive codebooks and fixed codebooks, respectively for speech signals of two channels, generates different excitation signals per channel and generates a synthesized signal. That is, the speech signal is subjected to CELP coding per channel, and the obtained coding information of each channel is outputted to the decoding side. Therefore, there is a problem that coded parameters corresponding to the number of channels are generated, the coding rate increases, and the circuit scale of the encoding apparatus also becomes larger. If the number of adaptive codebooks, the number of fixed codebooks, and the like are reduced, the coding rate and the circuit scale can be reduced, but, inversely, this leads to substantial deterioration of speech quality of a decoded signal. This problem also occurs with the scalable coding apparatus disclosed in Non-Patent Document 2.

It is therefore an object of the present invention to provide a scalable coding apparatus and a scalable coding method that make it possible to prevent speech quality of a decoded signal from deteriorating and reduce a coding rate and a circuit scale.

Means for Solving the Problem

The scalable coding apparatus of the present invention adopts a configuration including: a monaural coding section that encodes a monaural signal; a first predicting section that predicts an excitation of a first channel included in a stereo signal from an excitation obtained through encoding by the monaural coding section; a first channel coding section that encodes the first channel using the excitation predicted by the first predicting section; a second predicting section that predicts an excitation of a second channel included in the stereo signal from the excitations obtained through encoding by the monaural coding section and the first channel coding section; and a second channel coding section that encodes the second channel using the excitation predicted by the second predicting section.

Advantageous Effect of the Invention

The present invention makes it possible to prevent speech quality of a decoded signal from deteriorating, reduce a coding rate and reduce the circuit scale for a stereo speech signal.

BEST MODE FOR CARRYING OUT THE INVENTION

Embodiments of the present invention will be described in detail with reference to the accompanying drawings.

(Embodiment 1)

Figure 1:
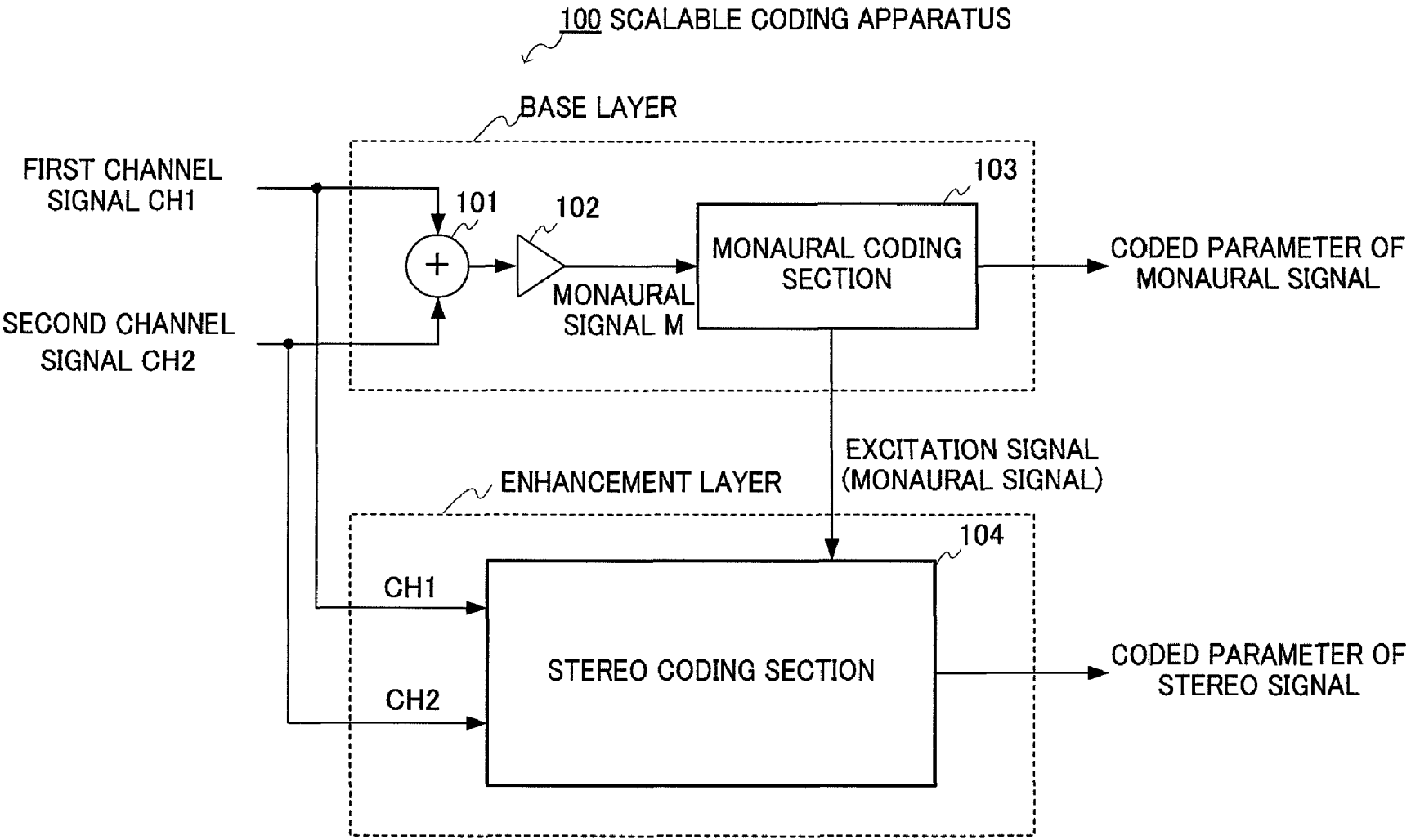
FIG. 1 is a block diagram showing the main configuration of a scalable coding apparatus according to Embodiment 1.

FIG. 1 is a block diagram showing the main configuration of scalable coding apparatus 100 according to Embodiment 1 of the present invention. Here, a case will be explained as an example where a stereo speech signal formed with two channels is encoded, and a first channel and a second channel described below refer to "L channel" and "R channel", respectively, or "R channel" and "L channel", respectively.

Scalable coding apparatus 100 has adder 101, multiplier 102, monaural coding section 103 and stereo coding section 104. Adder 101, multiplier 102 and monaural coding section 103 form a base layer, and stereo coding section 104 forms an enhancement layer.

The sections of scalable coding apparatus 100 carry out the following operations.

Adder 101 adds up first channel signal CH1 and second channel signal CH2 inputted to scalable coding apparatus 100 and generates a sum signal. Multiplier 102 multiplies this sum signal by ½, reduces the scale by half and generates monaural signal M. That is, adder 101 and multiplier 102 calculate an average signal of first channel signal CH1 and second channel signal CH2 and set this signal monaural signal M. Monaural coding section 103 encodes this monaural signal M and outputs obtained coded parameter. Here, in the case of CELP coding, for example, a coded parameter refers to an LPC (LSP) parameter, adaptive codebook index, adaptive excitation gain, fixed codebook index and fixed excitation gain. Furthermore, monaural coding section 103 outputs an excitation signal obtained upon encoding, to stereo coding section 104.

Stereo coding section 104 performs coding described later on first channel signal CH1 and second channel signal CH2 inputted to scalable coding apparatus 100 using the excitation signal outputted from monaural coding section 103 and outputs the obtained coded parameter of a stereo signal.

One of features of this scalable coding apparatus 100 is that a coded parameter of the monaural signal is outputted from the base layer and the coded parameter of the stereo signal is outputted from the enhancement layer. A decoding apparatus can obtain the stereo signal by decoding the coded parameter of this stereo signal together with the coded parameter of the base layer (monaural signal). That is, the scalable coding apparatus according to this embodiment realizes scalable coding formed with a monaural signal and a stereo signal. For example, even if the decoding apparatus which acquires the coded parameters of the base layer and enhancement layer cannot acquire the coded parameter of the enhancement layer due to deterioration of a channel environment and can acquire only the coded parameter of the base layer, the decoding apparatus can decode the monaural signal with low quality. Furthermore, if the decoding apparatus can acquire the coded parameters of both the base layer and the enhancement layer, the decoding apparatus can decode a high quality stereo signal using these parameters.

Figure 2:
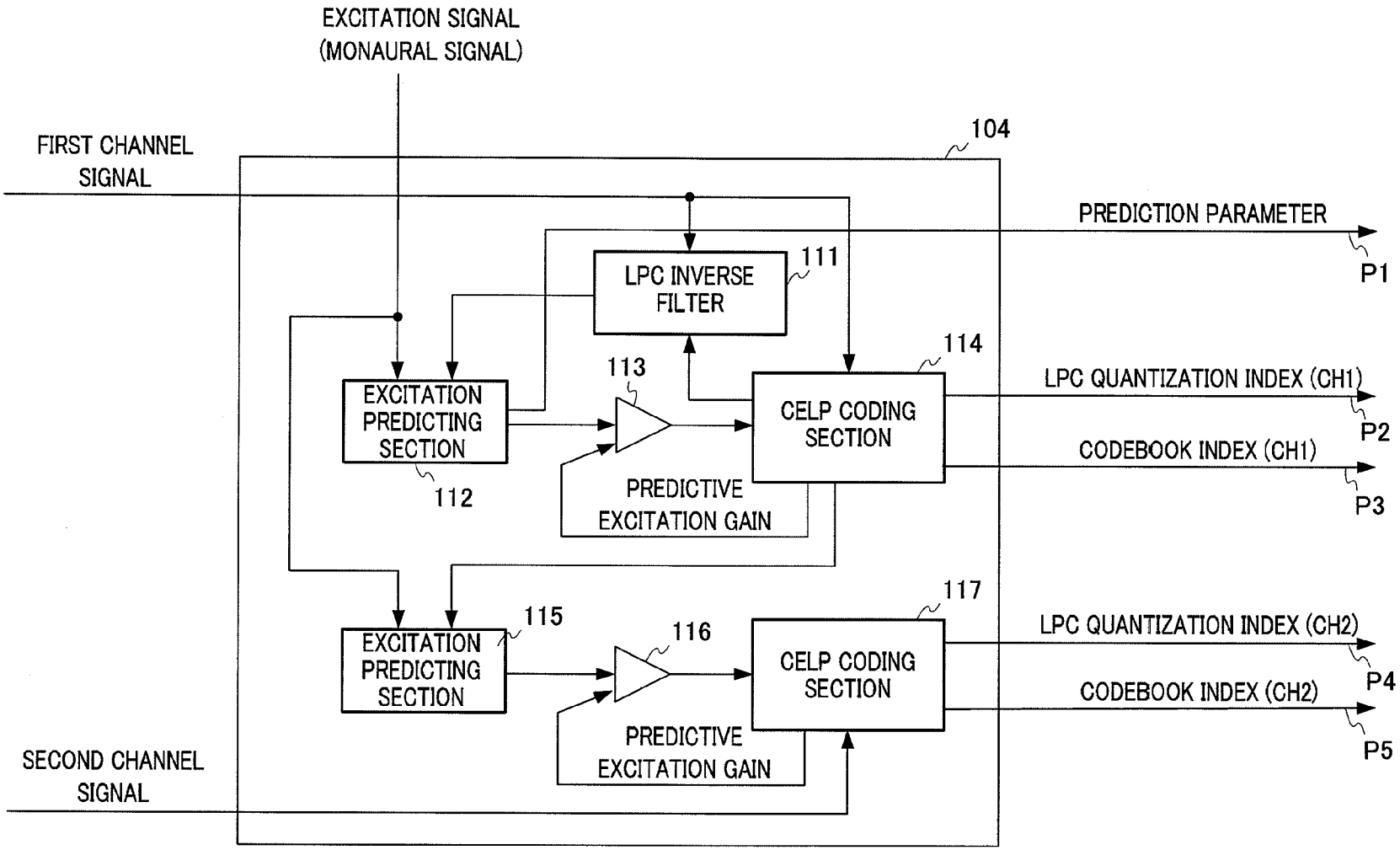
FIG. 2 is a block diagram showing the main internal configuration of a stereo coding section according to Embodiment 1.

FIG. 2 is a block diagram showing the main internal configuration of above-described stereo coding section 104.

Stereo coding section 104 has LPC inverse filter 111, excitation predicting section 112, multiplier 113, CELP coding section 114, excitation predicting section 115, multiplier 116 and CELP coding section 117 and is roughly divided into two systems of a system which performs processing on the first channel signal (LPC inverse filter 111, excitation predicting section 112, multiplier 113 and CELP coding section 114) and a system which performs processing on the second channel signal (excitation predicting section 115, multiplier 116 and CELP coding section 117).

First, the processing on the first channel signal will be described.

Excitation predicting section 112 predicts an excitation signal of the first channel from the excitation signal of the monaural signal outputted from monaural coding section 103 of the base layer, outputs the predicted excitation signal to multiplier 113 and outputs information (prediction parameters) P1 relating to this prediction. This prediction method will be described later. Multiplier 113 multiplies the excitation signal of the first channel obtained at excitation predicting section 112 by a predictive excitation gain fed back from CELP coding section 114 and outputs the result to CELP coding section 114. CELP coding section 114 performs CELP coding on the first channel signal using the excitation signal of the first channel outputted from multiplier 113 and outputs obtained LPC quantization index P2 and codebook index P3 for the first channel. Furthermore, CELP coding section 114 outputs the quantized LPC coefficients of the first channel signal obtained by LPC analysis and LPC quantization to LPC inverse filter 111. LPC inverse filter 111 performs inverse filtering processing on the first channel signal using these quantized LPC coefficients and outputs an obtained excitation signal of the first channel signal to excitation predicting section 112.

Next, the processing of the second channel signal will be described.

Excitation predicting section 115 predicts an excitation signal of the second channel from the excitation signal of the monaural signal outputted from monaural coding section 103 of the base layer and the excitation signal of the first channel signal outputted from CELP coding section 114 and outputs the predicted excitation signal to multiplier 116. This prediction method will be described later. Multiplier 116 multiplies the excitation signal of the second channel obtained at excitation predicting section 115 by a predictive excitation gain fed back from CELP coding section 117 and outputs the result to CELP coding section 117. CELP coding section 117 performs CELP coding on the second channel signal using the excitation signal of the second channel outputted from multiplier 116 and outputs obtained LPC quantization index P4 and codebook index P5 for the second channel.

Figure 3:
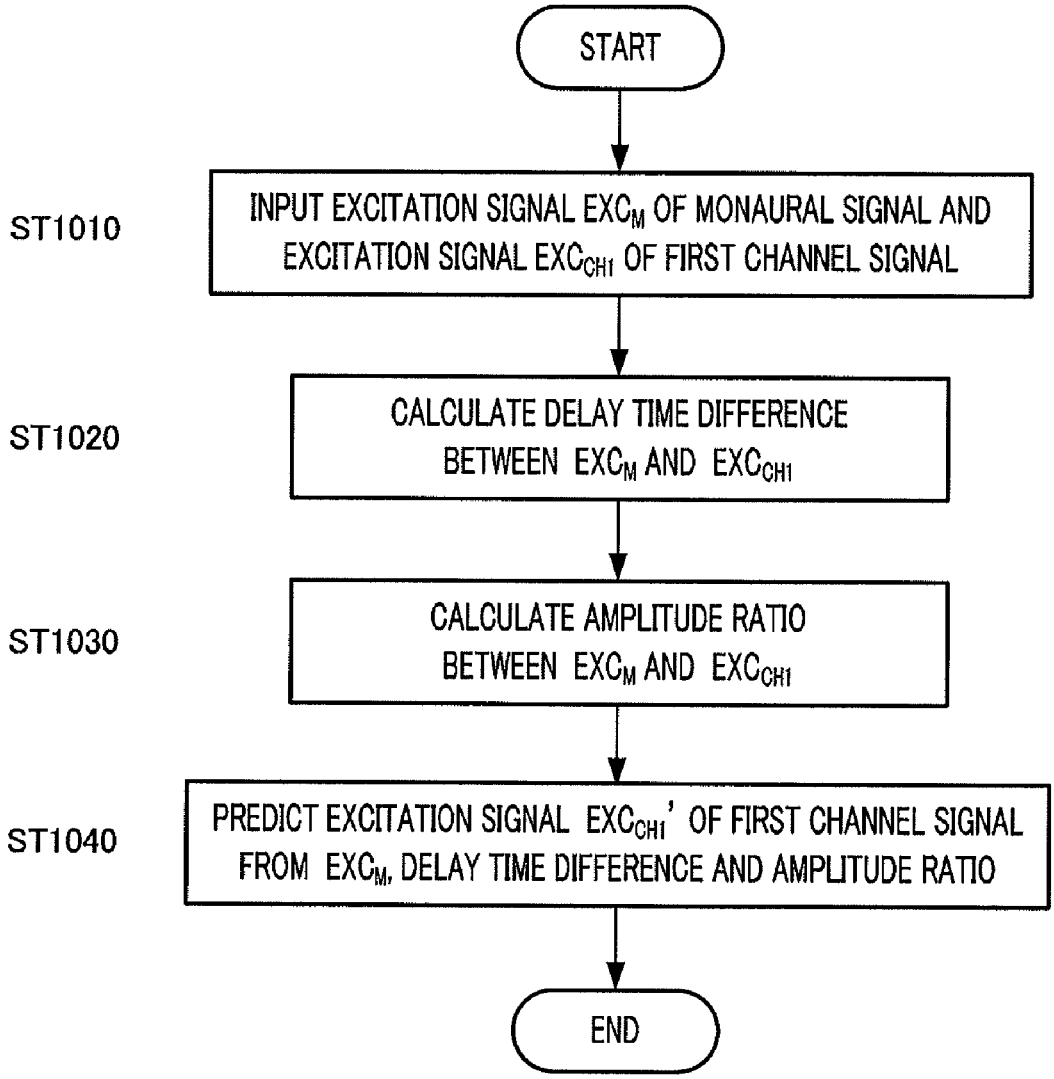
FIG. 3 is a flowchart illustrating steps of prediction processing carried out in an excitation predicting section according to Embodiment 1.

FIG. 3 is a flowchart illustrating steps of prediction processing carried out in excitation predicting section 112.

Excitation predicting section 112 receives excitation signal $EXC_M$ of the monaural signal and excitation signal $EXC_{CH1}$ of the first channel signal as input (ST1010). Excitation predicting section 112 calculates such a delay time difference that maximizes the value of a cross correlation function between these excitation signals (ST1020). Here, cross correlation function Φ of $EXC_M$ and $EXC_{CH1}$ is calculated by following equation 1.

(Equation 1)

$$\phi(m) = \sum_{n=0}^{FL-1} EXC_M(n-m) \cdot EXC_{CH1}(n) \quad [1]$$

n is a sample number of the excitation signal in a frame, and FL is the number of samples in one frame (frame length). Furthermore, it is assumed that m is the number of samples and takes values within a predetermined range from min_m to max_m, and, when Φ (m) becomes a maximum, m=M is a delay time difference of $EXC_{CH1}$ with respect to $EXC_M$.

Next, excitation predicting section 112 calculates an amplitude ratio as follows (ST1030). First, energy $E_M$ in one frame of $EXC_M$ is calculated by following equation 2 and energy $E_{CH1}$ in one frame of $EXC_{CH1}$ is calculated by following equation 3.

(Equation 2)

$$E_M = \sum_{n=0}^{FL-1} EXC_M(n)^2 \quad [2]$$

(Equation 3)

$$E_{CH1} = \sum_{n=0}^{FL-1} EXC_{CH1}(n)^2 \quad [3]$$

Here, as in equation 1, n is a sample number, and FL is the number of samples in one frame (frame length). Furthermore, $EXC_M(n)$ and $EXC_{CH1}(n)$ are amplitudes of the n-th samples of the excitation signal of the monaural signal and the excitation signal of the first channel signal, respectively. Next, square root C of the energy ratio of the excitation signal of the monaural signal and the excitation signal of the first channel signal is calculated according to following equation 4, and this square root C is set an amplitude ratio.

(Equation 4)

$$C = \sqrt{\frac{E_{CH1}}{E_M}} \quad [4]$$

Excitation predicting section 112 quantizes calculated delay time difference M and amplitude ratio C with the predetermined number of bits and calculates excitation signal $EXC_{CH1}'$ of the first channel signal from excitation signal $EXC_M$ of the monaural signal using quantized delay time difference $M_Q$ and amplitude ratio $C_Q$ according to following equation 5 (ST1040).

[5]

$$EXC_{CH1}'(n) = C_Q \cdot EXC_M(n - M_Q) \quad \text{(Equation 5)}$$

(where, n=0, . . . , FL-1)

Figure 4:
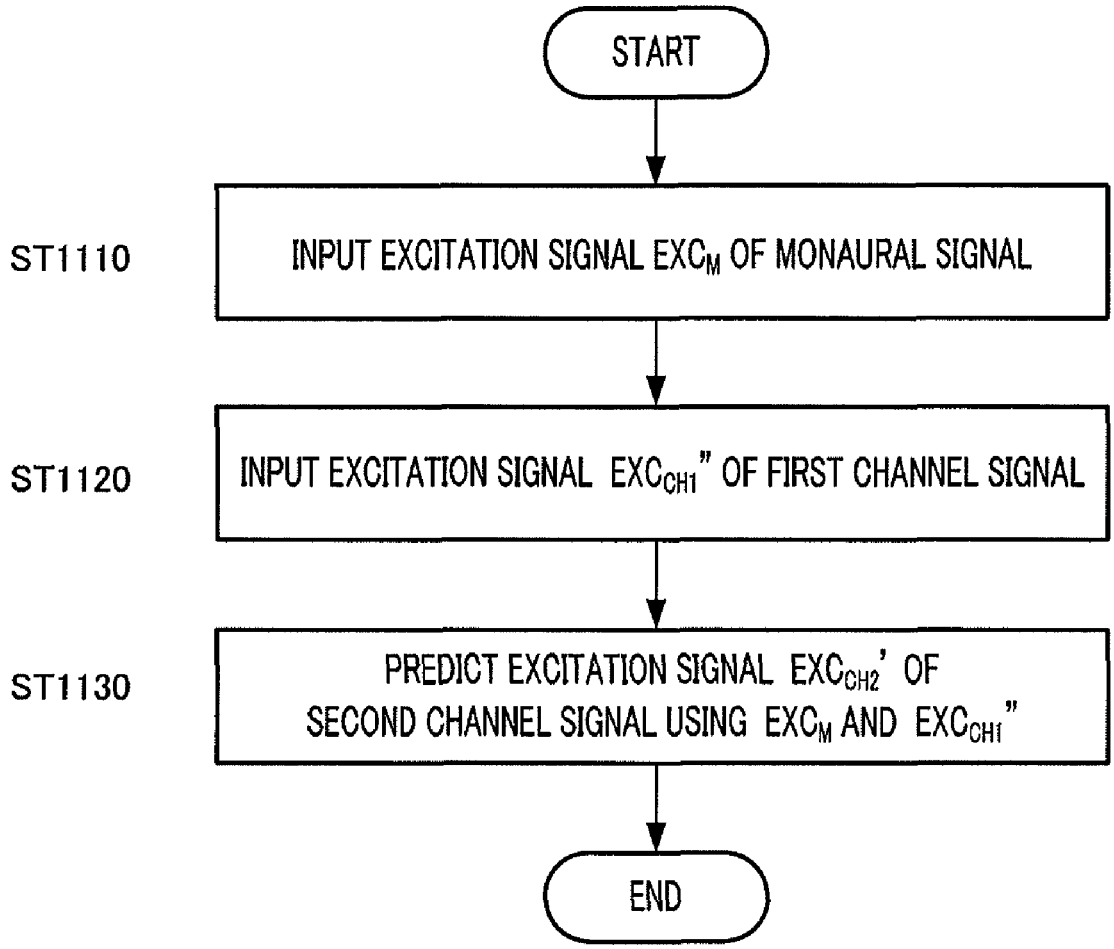
FIG. 4 is a flowchart illustrating steps of prediction processing carried out in the excitation predicting section according to Embodiment 1.

FIG. 4 is a flowchart illustrating steps of prediction processing carried out in excitation predicting section 115.

Excitation predicting section 115 calculates excitation signal $EXC_{CH2}'$ of the second channel using excitation signal $EXC_M$ of the monaural signal and excitation signal $EXC_{CH1}''$ (n) of the first channel signal according to following equation 6.

[6]

$$EXC_{CH2}'(n) = 2 \cdot EXC_M(n) - EXC_{CH1}''(n) \quad \text{(Equation 6)}$$

(where, n=0,
. . . , FL-1)

However, this equation 6 assumes that the monaural signal is an average of the first channel signal and the second channel signal.

Figure 5:
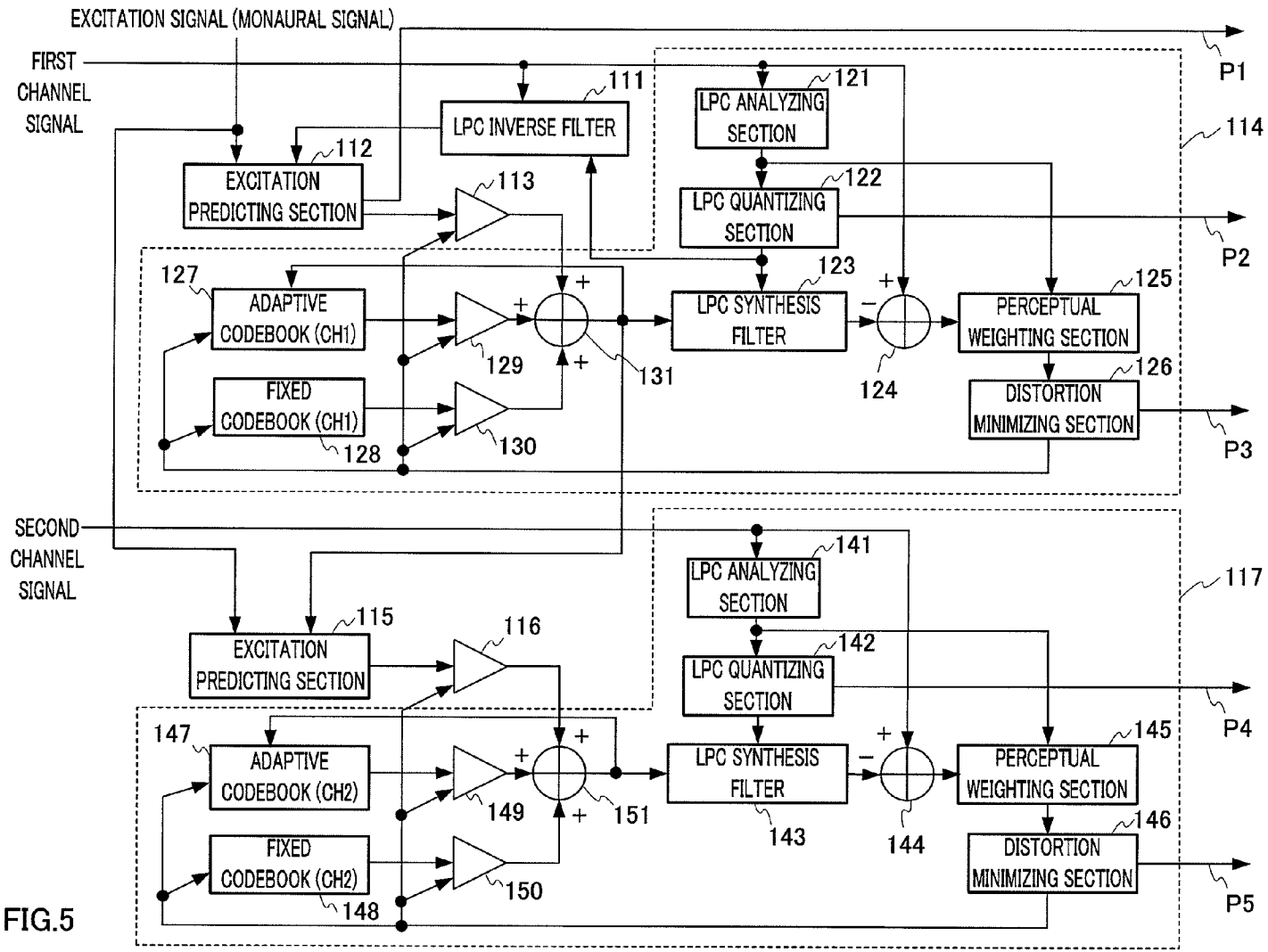
FIG. 5 is a block diagram illustrating in detail the internal configuration of the stereo coding section according to Embodiment 1.

FIG. 5 is a block diagram illustrating in more detail the internal configuration of stereo coding section 104.

As shown in this figure, stereo coding section 104 has adaptive codebook 127 and fixed codebook 128 for the first channel and generates an excitation signal for the first channel through codebook search controlled by distortion minimizing section 126.

LPC analyzing section 121 performs a linear predictive analysis on the first channel signal and obtains LPC coefficients which are spectral envelope information. LPC quantizing section 122 quantizes these LPC coefficients, outputs the obtained quantized LPC coefficients to LPC synthesis filter 123 and LPC inverse filter 111 and outputs LPC quantization index P2 indicating these quantized LPC coefficients.

On the other hand, adaptive codebook 127 outputs an excitation to multiplier 129 according to an instruction from distortion minimizing section 126. In the same way, fixed codebook 128 also outputs an excitation to multiplier 130 according to an instruction from distortion minimizing section 126. Multiplier 129 and multiplier 130 multiply the outputs from adaptive codebook 127 and fixed codebook 128 by an adaptive codebook gain and a fixed codebook gain, respectively according to an instruction from distortion minimizing section 126 and output the multiplication results to adder 131. Adder 131 adds the excitation signals outputted from the codebooks to the excitation signal of the monaural signal predicted by excitation predicting section 112.

LPC synthesis filter 123 is driven by the excitation signal outputted from adder 131 using the quantized LPC coefficients outputted from LPC quantizing section 122 as a filter coefficient, and outputs a synthesized signal to adder 124. Adder 124 calculates coding distortion by subtracting the synthesized signal from the first channel signal and outputs the result to perceptual weighting section 125. Perceptual weighting section 125 performs perceptual weighting on the coding distortion using a perceptual weighting filter which uses the LPC coefficients outputted from LPC analyzing section 121 as a filter coefficient and outputs the result to distortion minimizing section 126.

Distortion minimizing section 126 finds per subframe such indices of adaptive codebook 127 and fixed codebook 128 that minimize the coding distortion outputted through perceptual weighting section 125 and outputs these indices as coded parameters P3. The excitation signal of the first channel signal for which the coding distortion becomes a minimum is expressed as $EXC_{CH1}''$ (n) in above equation 6.

The excitation (output of adder 131) for which the coding distortion becomes a minimum is fed back to adaptive codebook 127 per subframe.

On the other hand, stereo coding section 104 has adaptive codebook 147 and fixed codebook 148 for the second channel and generates an excitation signal for the second channel through codebook search. Adder 151 adds excitation signals outputted from the codebooks to the excitation signal of the monaural signal predicted at excitation predicting section 115. These excitation signals are multiplied by appropriate gains by multipliers 116, 149 and 150.

LPC synthesis filter 143 is driven by the excitation signal of the second channel outputted from adder 151 using the LPC coefficients which are LPC-analyzed by LPC analyzing section 141 and quantized by LPC quantizing section 142, and outputs a synthesized signal to adder 144. Adder 144 calculates coding distortion by subtracting the synthesized signal from the second channel signal and outputs the result to perceptual weighting section 145.

Distortion minimizing section 146 calculates per subframe such indices of adaptive codebook 147 and fixed codebook 148 that minimize the coding distortion outputted through perceptual weighting section 145 and outputs these indices as coded parameters P5. The excitation signal of the first channel signal for which the coding distortion becomes a minimum is expressed as $EXC_{CH1}''(n)$ in above equation 6.

Generated coded parameters P1 to P5 are transmitted to the decoding apparatus as coded parameters of the stereo signal and are used to decode the second channel signal.

In this way, according to this embodiment, stereo coding section 104 of the enhancement layer performs CELP coding on the first channel before the second channel using the monaural signal and efficiently encodes the second channel using the result of CELP coding of the first channel. As for the excitation in particular, by focusing that there is high correlation between each channel signal forming the stereo signal and the monaural signal, this embodiment predicts the excitation of the first channel from the excitation of the monaural signal, improves the prediction efficiency and reduces the coding rate for the excitation information, and, on the other hand, performs LPC analysis and encodes the vocal tract information of the first channel as is, in CELP coding of the first channel. Therefore, the prediction accuracy of the excitation of the first channel and the second channel improves, so that it is possible to prevent speech quality of the decoded signal from deteriorating and reduce the coding rate for the stereo speech signal. Furthermore, this embodiment can reduce the circuit scale.

Although a case has been described with this embodiment as an example where amplitude ratio C is calculated after delay time difference M is calculated, these processings can also be performed simultaneously or in the reverse order.

Furthermore, although a case has been described with this embodiment as an example where the monaural signal is calculated as an average of the first channel and the second channel, the method is not limited to this, and the monaural signal may also be calculated using other methods.

Furthermore, stereo coding section 104 according to this embodiment performs CELP coding on the first channel using the excitation of the monaural signal first and then efficiently encodes the second channel using the result of CELP coding of the first channel. Therefore, the coding accuracy of the first channel encoded first also influences the coding accuracy of the second channel. Therefore, if more bits are allocated in CELP coding of the first channel than in CELP coding of the second channel, it is possible to improve coding performance of the encoding apparatus.

(Embodiment 2)

To be more specific, the "first channel" and the "second channel" used in Embodiment 1 refer to "R channel" or "L channel" in a stereo signal. A case has been described with Embodiment 1 where there is no particular limitation in to which of R channel and L channel the first channel and the second channel correspond, and the first channel and the second channel may correspond to one of the two. However, when the first channel is limited to a specific channel using a method as shown below, that is, when one of R channel and L channel is selected as the first channel, the coding performance of the scalable coding apparatus can be further improved.

Figure 6:
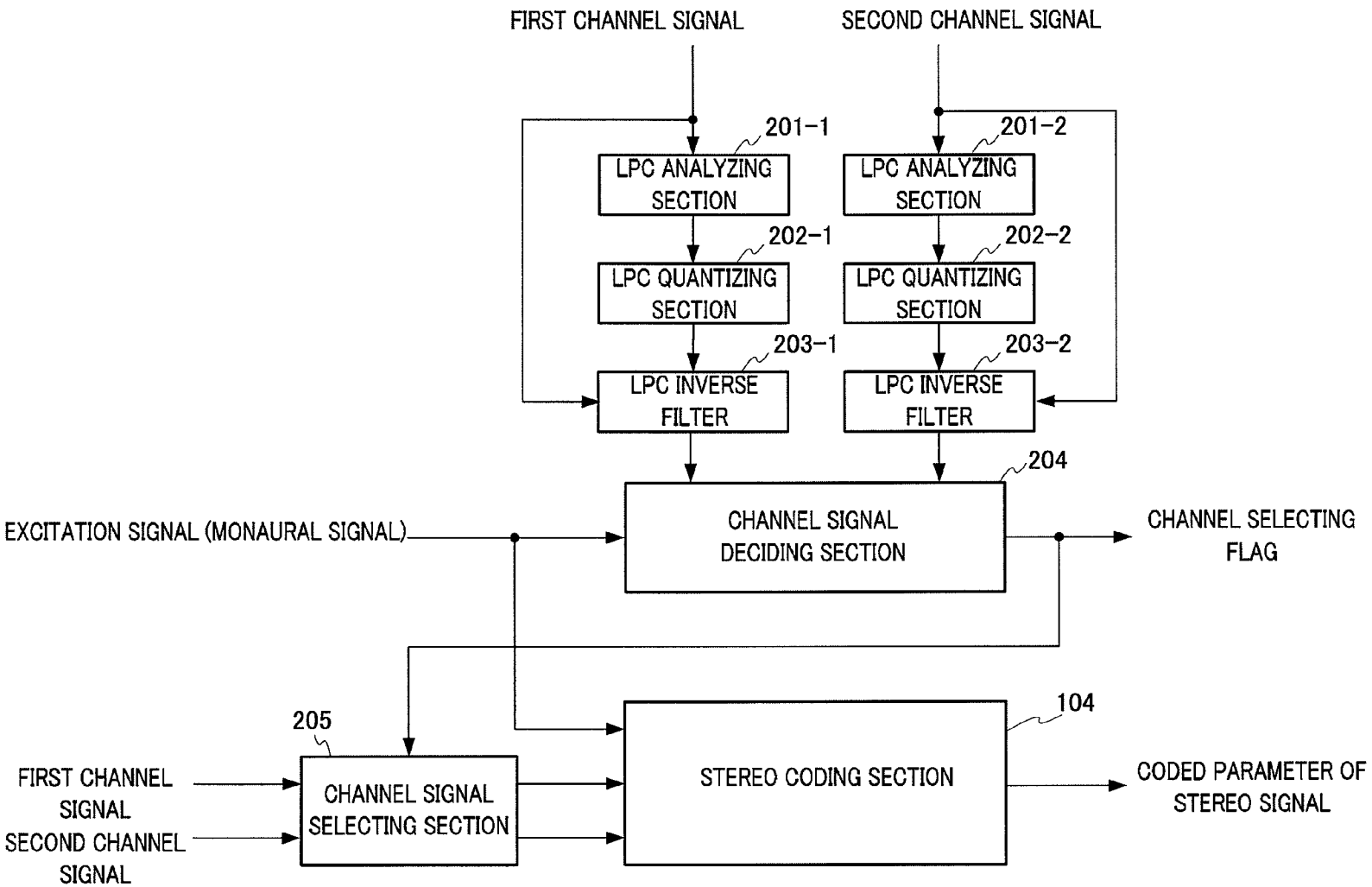
FIG. 6 is a block diagram showing the main configuration of an enhancement layer of the scalable coding apparatus according to Embodiment 2.

FIG. 6 is a block diagram showing the main configuration of an enhancement layer of a scalable coding apparatus according to Embodiment 2 of the present invention. The same components of the scalable coding apparatus described in Embodiment 1 are assigned the same reference numerals, and description thereof will be omitted.

A first channel signal is LPC analyzed at LPC analyzing section 201-1 and quantized at LPC quantizing section 202-1, and an excitation signal of the first channel signal is calculated using the quantized LPC coefficients at LPC inverse filter 203-1 and outputted to channel signal deciding section 204. LPC analyzing section 201-2, LPC quantizing section 202-2 and LPC inverse filter 203-2 perform the same processing as performed on the first channel signal, on a second channel signal.

Channel signal deciding section 204 calculates a cross correlation function between the excitation signals of the inputted first channel signal and second channel signal and an excitation signal of the monaural signal according to following equations 7 and 8, respectively.

(Equation 7)

$$\phi_{CH1}(m) = \sum_{n=0}^{FL-1} EXC_M(n-m) \cdot EXC_{CH1}(n) \quad [7]$$

(Equation 8)

$$\phi_{CH2}(m) = \sum_{n=0}^{FL-1} EXC_M(n-m) \cdot EXC_{CH2}(n) \quad [8]$$

Channel signal deciding section 204 searches m's that maximize calculated $\Phi_{CH1}(m)$ and $\Phi_{CH2}(m)$, compares the values of $\Phi_{CH1}(m)$ and $\Phi_{CH2}(m)$ when m's become the maximum values, and selects as the first channel the channel which shows a greater value, that is, the channel with higher correlation. The channel selecting flag indicating this selected channel is outputted to channel signal selecting section 205. Furthermore, the channel selecting flag is outputted to the decoding apparatus per frame as a coded parameter together with the LPC quantization index and the codebook index.

Based on the channel selecting flag outputted from channel signal deciding section 204, channel signal selecting section 205 distributes the input stereo signals (R channel signal and L channel signal) as the first channel signal and second channel signal which are the inputs of stereo coding section 104.

In this way, according to this embodiment, a channel having higher correlation with the monaural signal is selected and used as the first channel of stereo coding section 104. This allows improvement of the coding performance of the encoding apparatus. This is because stereo coding section 104 performs CELP coding on the first channel using the excitation of the monaural signal first and then efficiently encodes the second channel using the result of CELP coding of the first channel. Therefore, the coding accuracy of the first channel encoded first also influences the coding accuracy of the second channel. That is, if a channel having higher correlation with the monaural signal is used as the first channel as in this embodiment, it is easily understood that the coding accuracy of the first channel improves.

Furthermore, for the same reason, if more bits are allocated in the CELP coding of the first channel than in the CELP coding of the second channel, it is possible to further improve the coding performance of the encoding apparatus.

Channel selecting flags can be transmitted not per frame but also collectively so that a plurality of frames can select the same channel signal. Alternatively, it is also possible to calculate a cross correlation function of several frames first, then determine which channel signal should be used as the first channel and transmit the channel selecting flag first.

(Embodiment 3)

Embodiment 3 of the present invention will disclose a method of changing bit allocation at a scalable coding apparatus according to the present invention.

Generally, when the number of coding bits allocated to coding increases, coding distortion decreases. For example, the scalable coding apparatus according to the present invention encodes the first channel signal and the second channel signal, so that, if the number of coding bits allocated to both the first channel signal and the second channel signal can be increased, both coding distortion of the first channel and coding distortion of the second channel can be decreased. However, there is an upper limit to the sum of the number of bits allocated to the first channel and the number of bits allocated to the second channel. Therefore, when the number of bits allocated to the first channel increases, the coding distortion of the first channel signal decreases, but the number of bits allocated to the second channel decreases, and therefore the coding distortion of the second channel signal increases.

However, as for the scalable coding apparatus according to the present invention, the increase in the number of bits for the first channel has not only negative influence on the coding distortion of the second channel. This is because the excitation signal of the second channel in the scalable coding apparatus according to the present invention is predicted from the excitation signal of the monaural signal and the excitation signal of the first channel signal (see FIG. 4), and therefore coding distortion of the second channel signal depends on coding distortion of the first channel signal. Therefore, if the mutual dependence between the coding distortion of the first channel and the coding distortion of the second channel is taken into consideration, when the number of bits allocated to the first channel increases, the coding distortion of the second channel signal also decreases in accordance with the decrease in the coding distortion of the first channel. That is, in the scalable coding apparatus according to the present invention, the increase in the number of bits for the first channel also has positive influence on the coding distortion of the second channel.

Therefore, the scalable coding apparatus according to this embodiment improves the overall coding efficiency of the scalable coding apparatus by adaptively distributing the number of bits to the first channel and the second channel. To be more specific, this embodiment adaptively allocates the number of bits to the first channel and the second channel so that the coding distortion of the first channel becomes equal to the coding distortion of the second channel.

Scalable coding apparatus 300 according to this embodiment has the same basic configuration as scalable coding apparatus 100 shown in Embodiment 1 (see FIG. 1), and the block diagram showing the configuration of scalable coding apparatus 300 will be omitted. Stereo coding section 304 of scalable coding apparatus 300 has a configuration and operations partially different from stereo coding section 104 shown in Embodiment 1, and those different parts will be assigned different reference numerals. Bit allocation of scalable coding apparatus 300 is carried out inside stereo coding section 304.

Figure 7:
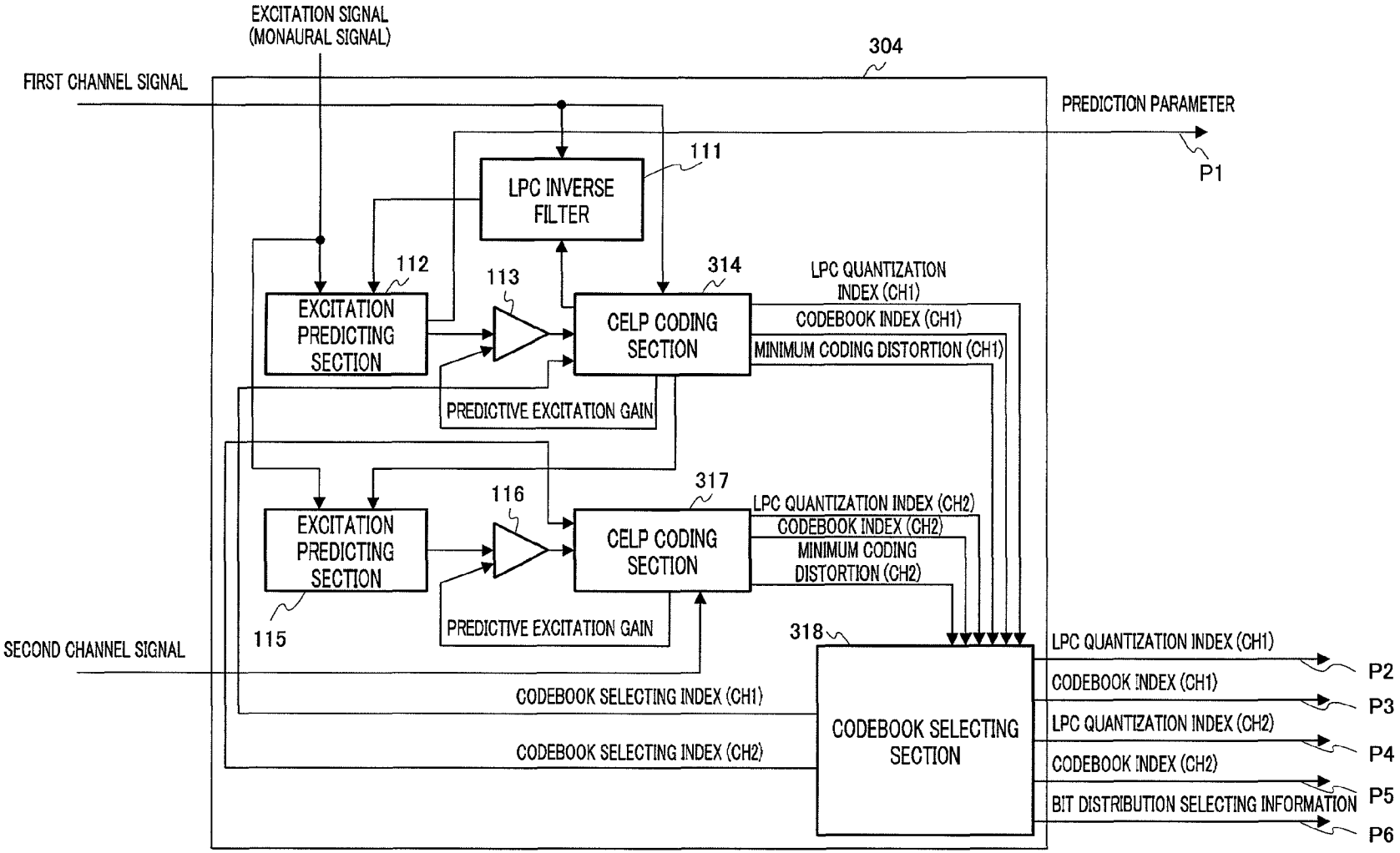
FIG. 7 is a block diagram showing the main internal configuration of a stereo coding section according to Embodiment 3.

FIG. 7 is a block diagram showing the main internal configuration of stereo coding section 304 according to this embodiment. Stereo coding section 304 has the same basic configuration as stereo coding section 104 (see FIG. 2) shown in Embodiment 1, the same components are assigned the same reference numerals, and description thereof will be omitted. Stereo coding section 304 according to this embodiment differs from stereo coding section 104 shown in Embodiment 1 in that stereo coding section 304 further includes codebook selecting section 318. CELP coding section 314 and CELP coding section 317 have the same basic configurations as CELP coding section 114 and CELP coding section 117 shown in Embodiment 1 and partially differ in configurations and the operations. Hereinafter, these differences will be described.

CELP coding section 314 differs from CELP coding section 114 shown in Embodiment 1 in that CELP coding section 314 outputs an LPC quantization index for the first channel and a codebook index for the first channel to codebook selecting section 318 instead of outputting these indices as coded parameters. Furthermore, CELP coding section 314 further differs from CELP coding section 114 shown in Embodiment 1 in that CELP coding section 314 outputs minimum coding distortion of the first channel signal to codebook selecting section 318 and receives as feedback a codebook selection index for the first channel from codebook selecting section 318. Here, the minimum coding distortion of the first channel refers to a minimum value of the coding distortion of the first channel signal obtained through closed loop distortion minimizing processing carried out to minimize coding distortion of the first channel inside CELP coding section 314.

CELP coding section 317 differs from CELP coding section 117 shown in Embodiment 1 in that CELP coding section 317 outputs an LPC quantization index for the second channel and a codebook index for the second channel to codebook selecting section 318 instead of outputting these indices as coded parameters. Furthermore, CELP coding section 317 further differs from CELP coding section 117 shown in Embodiment 1 in that CELP coding section 317 outputs minimum coding distortion of the second channel signal to codebook selecting section 318 and receives as feedback a codebook selection index for the second channel from codebook selecting section 318. Here, the minimum coding distortion of the second channel refers to a minimum value of the coding distortion of the second channel signal obtained through closed loop distortion minimizing processing carried out to minimize coding distortion of the second channel inside CELP coding section 317.

Codebook selecting section 318 receives as input the LPC quantization index for the first channel, the codebook index for the first channel and the minimum coding distortion of the first channel signal from CELP coding section 314, and the LPC quantization index for the second channel, the codebook index for the second channel and the minimum coding distortion of the second channel signal from CELP coding section 317. Codebook selecting section 318 carries out codebook selection processing using these inputs, feeds back a codebook selecting index for the first channel to CELP coding section 314 and feeds back a codebook selecting index for the second channel to CELP coding section 317. The codebook selection processing by codebook selecting section 318 changes the number of bits allocated to CELP coding section 314 and CELP coding section 317 so that the minimum coding distortion of the first channel signal becomes equal to the minimum coding distortion of the second channel signal and indicates change information of the number of bits using the codebook selecting index for the first channel and the codebook selecting index for the second channel. Codebook selecting section 318 outputs LPC quantization index P2 for the first channel, codebook index P3 for the first channel, LPC quantization index P4 for the second channel, codebook index P5 for the second channel and bit allocation selecting information P6 as coded parameters.

Figure 8:
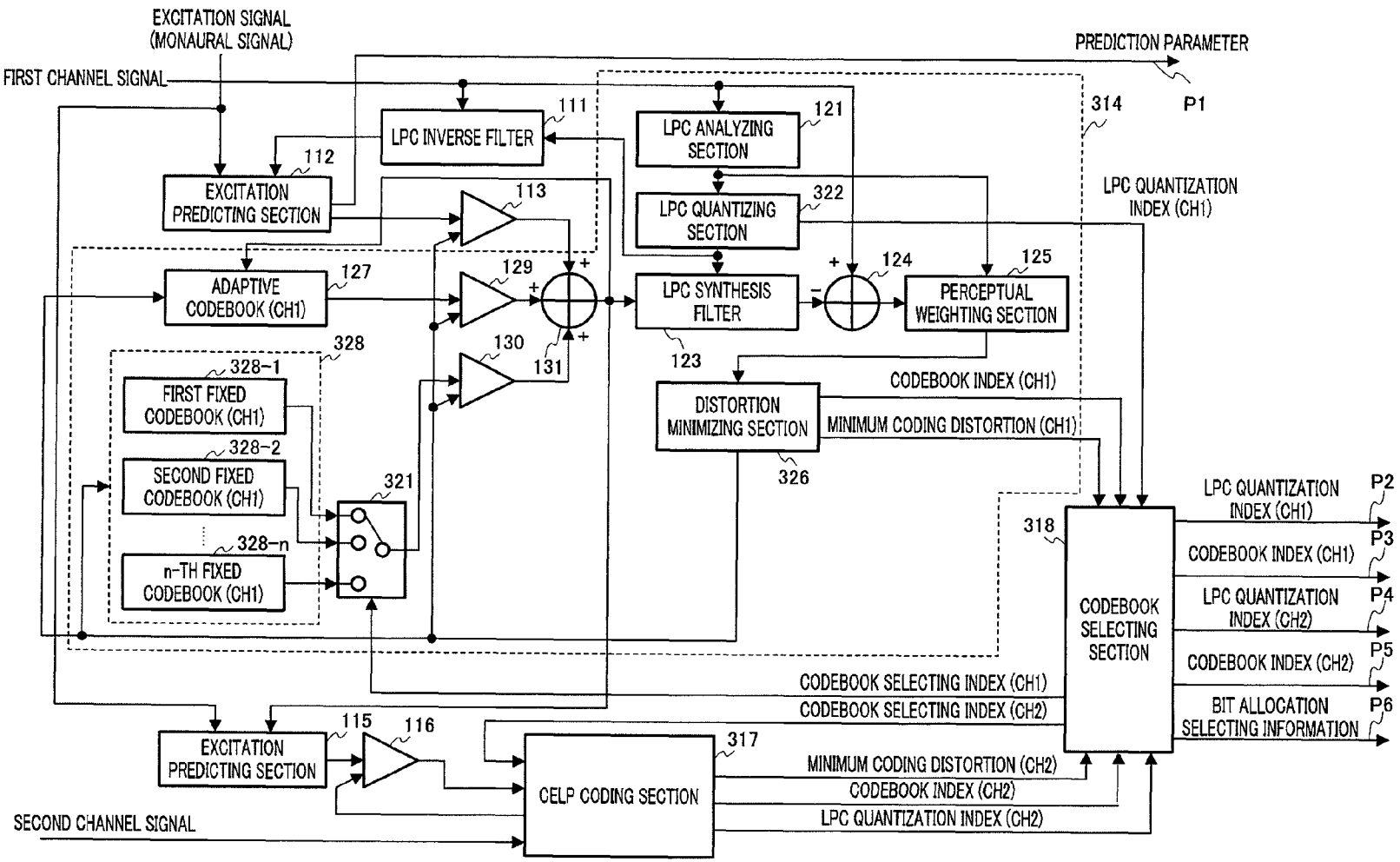
FIG. 8 is a block diagram illustrating in detail the internal configuration of the stereo coding section according to Embodiment 3.

FIG. 8 is a block diagram illustrating in detail the internal configuration of stereo coding section 304 according to this embodiment. This figure mainly shows the more detailed internal configuration of CELP coding section 314. The internal configuration of CELP coding section 317 is the same as the internal configuration of CELP coding section 314, and therefore indication and description thereof will be omitted. In this figure, description of the same components as those shown in FIG. 5 of Embodiment 1 will be omitted, and only different parts will be described.

Fixed codebook 328 differs from fixed codebook 128 shown in Embodiment 1 in that fixed codebook 328 consists of first fixed codebook 328-1 to n-th fixed codebook 328-*n*, outputs an excitation of one of first fixed codebook 328-1 to n-th fixed codebook 328-*n* and outputs the excitation to switching section 321 instead of multiplier 130. First fixed codebook 328-1 to n-th fixed codebook 328-*n* are n fixed codebooks having bit rates different from each other, and fixed codebook 328 changes the number of coding bits for the first channel by changing an excitation output using switching section 321.

Generally, the number of bits required by the fixed codebook is larger than the number of bits required by the adaptive codebook, and coding distortion is more improved by changing the number of bits allocated to fixed codebook 328 than by changing the number of bits allocated to adaptive codebook 127. Therefore, this embodiment changes the number of bits allocated to both channels by changing the fixed codebook index of fixed codebook 328 instead of changing the codebook index of adaptive codebook 127.

LPC quantizing section 322 differs from LPC quantizing section 122 shown in Embodiment 1 in that LPC quantizing section 322 outputs the LPC quantization index for the first channel to codebook selecting section 318 instead of outputting the index as a coded parameter.

Distortion minimizing section 326 differs from distortion minimizing section 126 described in Embodiment 1 in that distortion minimizing section 326 outputs a codebook index for the first channel to codebook selecting section 318 instead of outputting the index as a coded parameter and further outputs the minimum coding distortion of the first channel signal to codebook selecting section 318. Here, the minimum coding distortion of the first channel signal refers to a minimum value of the coding distortion of the first channel signal finally obtained by performing at distortion minimizing section 326 closed loop distortion minimizing processing so as to minimize coding distortion of the first channel, while switching between first fixed codebook 328-1 to n-th fixed codebook 328-*n* according to an instruction of codebook selecting section 318

Codebook selecting section 318 receives as input the LPC quantization index for the first channel from LPC quantizing section 322 and receives as input the codebook index for the first channel and the minimum coding distortion of the first channel signal from distortion minimizing section 326. Similarly, codebook selecting section 318 receives as input the LPC quantization index for the second channel, the codebook index for the second channel and the minimum coding distortion of the second channel signal from CELP coding section 317. Codebook selecting section 318 carries out codebook selection processing using these inputs, feeds back a codebook selecting index for the first channel to switching section 321 and feeds back a codebook selecting index for the second channel to CELP coding section 317. The codebook selecting index for the first channel is an index which indicates each of first fixed code book 328-1 to n-th fixed codebook 328-*n* and is used by fixed codebook 328 to encode the first channel. Codebook selecting section 318 outputs LPC quantization index P2 for the first channel, codebook index P3 for the first channel, LPC quantization index P4 for the second channel, codebook index P5 for the second channel and bit allocation selecting information P6 as coded parameters.

Switching section 321 switches paths between fixed codebooks 328 and multiplier 130 based on the codebook selecting index inputted from codebook selecting section 318. For example, when the codebook which is inputted from codebook selecting section 318 and indicated by the codebook selecting index is second fixed codebook 328-2, switching section 321 performs switching so as to output the excitation of second fixed codebook 328-2 to multiplier 130.

Figure 9:
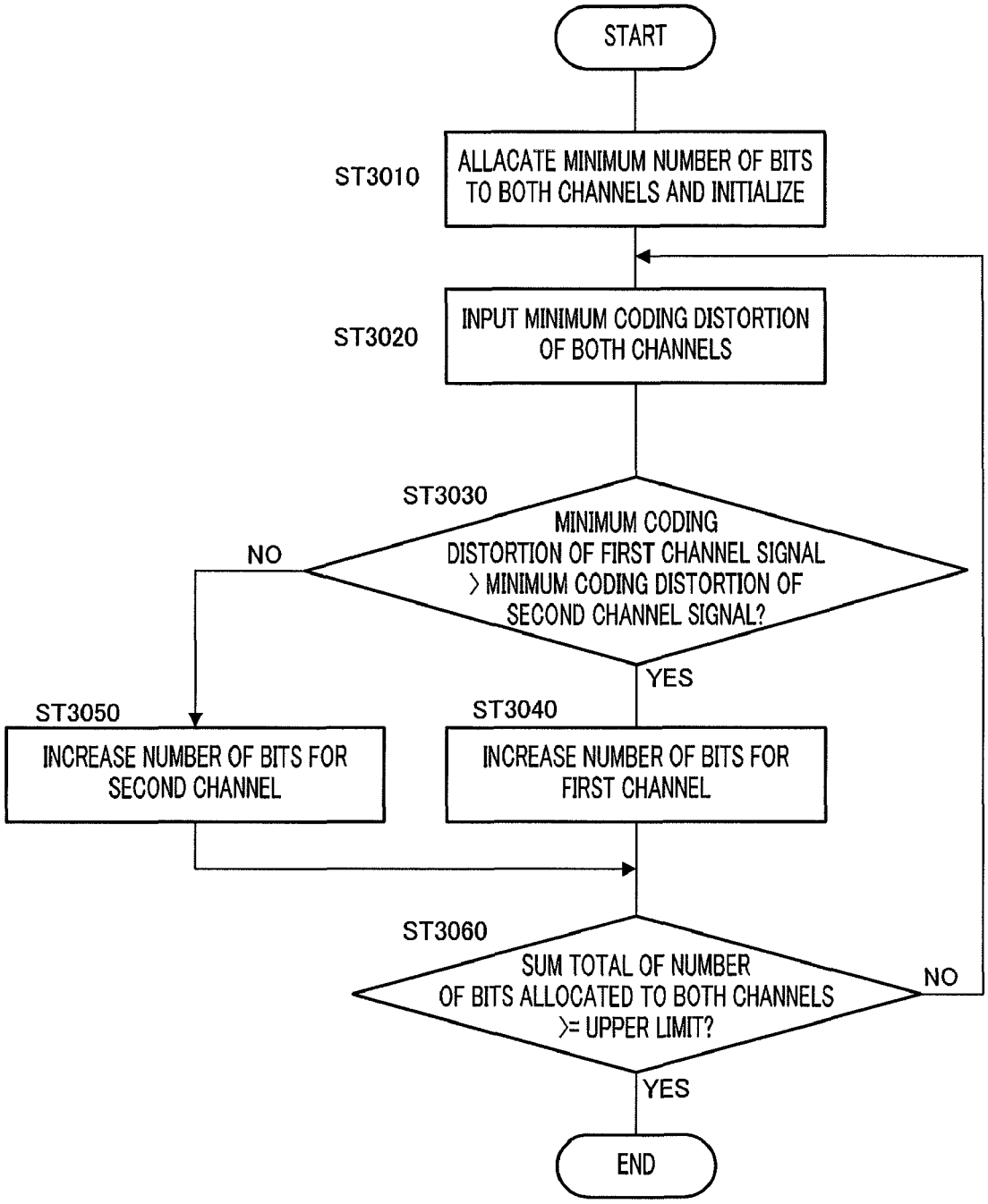
FIG. 9 is a flowchart showing steps of bit allocation processing in a codebook selecting section according to Embodiment 3.

FIG. 9 is a flowchart showing steps of bit allocation processing in codebook selecting section 318. The processings shown in this figure are carried out in frame units, and bits are allocated so that coding distortion of the first channel signal becomes equal to coding distortion of the second channel signal.

First, in ST3010, codebook selecting section 318 allocates a minimum number of bits to both channels as initialization of bit allocation processing. That is, codebook selecting section 318 instructs fixed codebook 328 to use the fixed codebook that minimizes the bit rate, for example, second fixed codebook 328-2, through the codebook selecting index for the first channel. The processing of codebook selecting section 318 performed on the second channel is the same as the processing performed on the first channel.

Next, in ST3020, the minimum coding distortion of the first channel signal and the minimum coding distortion of the second channel signal are inputted to codebook selecting section 318. That is, when, for example, second fixed codebook 328-2 is used as fixed codebook 328, distortion minimizing section 326 calculates the minimum value of the coding distortion of the first channel signal and outputs the calculated minimum value to codebook selecting section 318. Here, the fixed codebook used by fixed codebook 328 is instructed from code book selecting section 318 in a step before ST3020. In ST3020, the processing performed on the second channel is the same as the processing performed on the first channel.

Next, in ST3030, codebook selecting section 318 compares the minimum coding distortion of the first channel signal with the minimum coding distortion of the second channel signal. In ST3040, when the minimum coding distortion of the first channel signal is greater than the minimum coding distortion of the second channel signal, codebook selecting section 318 increases the number of bits for the first channel. That is, codebook selecting section 318 instructs fixed codebook 328 to use a codebook having a higher bit rate, for example, fourth fixed codebook 328-4, through the codebook selecting index for the first channel. On the other hand, in ST3050, when the minimum coding distortion of the first channel signal is smaller than the minimum coding distortion of the second channel signal, codebook selecting section 318 increases the number of bits for the second channel. The method of increasing the number of bits for the second channel is the same as the method of increasing the number of bits for the first channel.

Next, in ST3060, it is decided whether or not the sum total of the number of bits already allocated to both channels reaches an upper limit. When the sum total of the number of bits allocated to both channels does not reach the upper limit, the flow returns to ST3020, and codebook selecting section 318 repeats the processings from ST3020 to ST3060 until the sum total of the number of bits allocated to both channels reaches the upper limit.

As described above, codebook selecting section 318 allocates a minimum bit rate to both channels first, gradually increases the number of bits allocated to both channels while maintaining the coding distortion of the first channel signal equal to the coding distortion of the second channel signal, and finally allocates a number of bits corresponding to a predetermined upper limit to both channels. That is, the sum total of the number of bits allocated to both channels gradually increases from the minimum value and finally reaches the predetermined upper limit in accordance with the progress of the processing.

Figure 10:
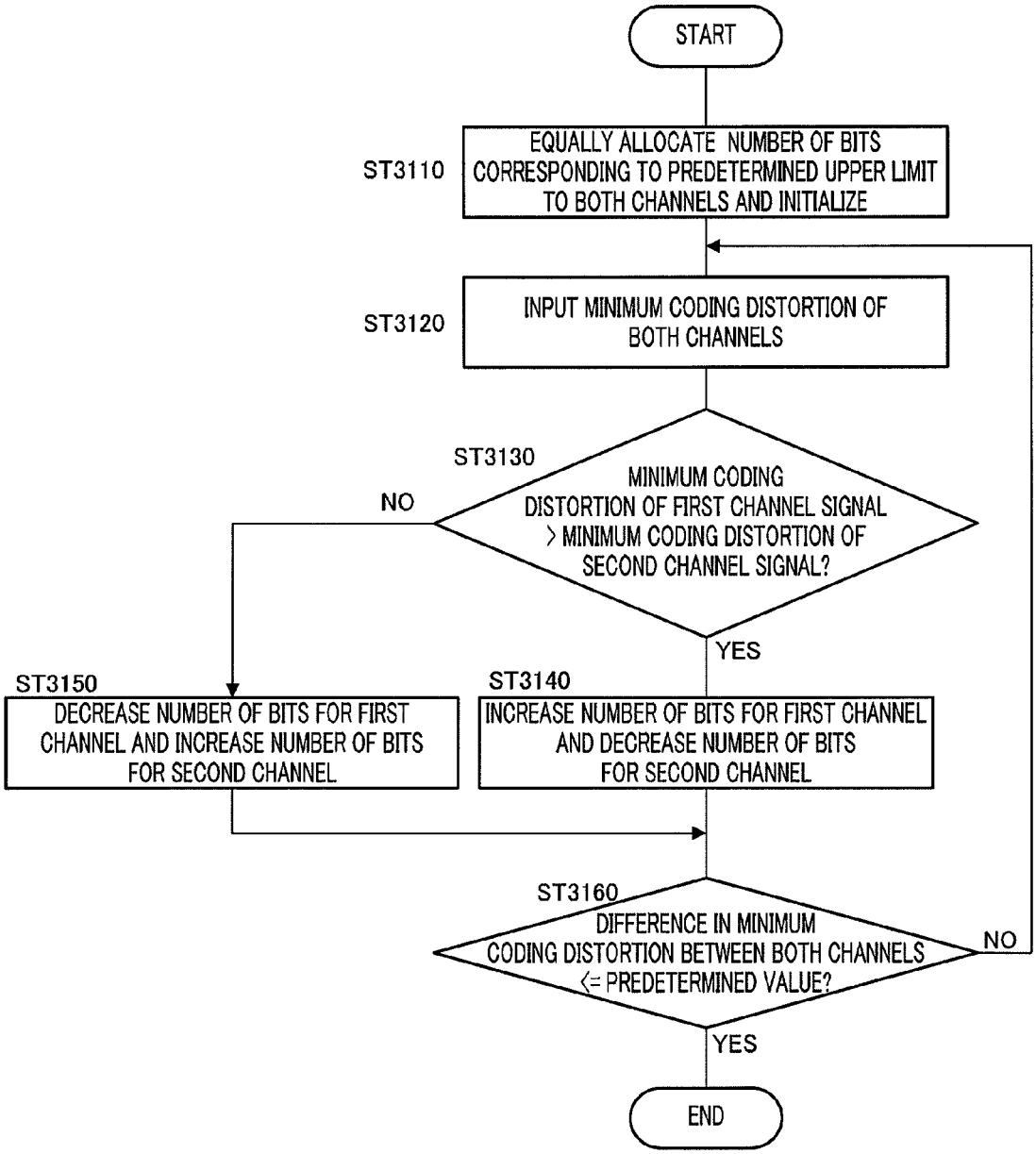
FIG. 10 is a flowchart showing another step of bit allocation processing in the codebook selecting section according to Embodiment 3.

FIG. 10 is a flowchart showing another step of bit allocation processing by codebook selecting section 318. The processing shown in this figure is also carried out in frame units as in the processing shown in FIG. 9, and bits are allocated so that the minimum coding distortion of the first channel signal becomes equal to the minimum coding distortion of the second channel signal. In contrast with the processing shown in FIG. 9 where the sum total of the number of bits allocated to both channels gradually increases from the minimum value and finally reaches a predetermined upper limit in accordance with the progress of the processing, the processing shown in this figure equally allocates a number of bits corresponding to a predetermined upper limit to both channels from the beginning and adjusts the proportion of the numbers of bits for both channels until the coding distortion of the first channel signal becomes equal to the coding distortion of the second channel signal. Description of detailed operation of the components of scalable coding apparatus 300 in the processing steps will be omitted (see description in FIG. 10).

First, in ST3110, codebook selecting section 318 equally allocates the number of bits corresponding to the predetermined upper limit to both channels as initialization of bit allocation processing. Next, in ST3120, codebook selecting section 318 receives as input the minimum coding distortion of the first channel signal and the minimum coding distortion of the second channel signal. Next, in ST3130, codebook selecting section 318 compares the minimum coding distortion of the first channel signal with the minimum coding distortion of the second channel signal. In ST3140, when the minimum coding distortion of the first channel signal is greater than the minimum coding distortion of the second channel signal, codebook selecting section 318 increases the number of bits for the first channel and decreases the number of bits for the second channel. In this case, the amount of increase in the number of bits for the first channel is the same as the amount of decrease in the number of bits for the second channel. In ST3150, on the other hand, when the minimum coding distortion of the first channel signal is smaller than the minimum coding distortion of the second channel signal, codebook selecting section 318 decreases the number of bits for the first channel and increases the number of bits for the second channel. In this case, the amount of decrease in the number of bits for the first channel is the same as the amount of increase in the number of bits for the second channel. Next, in ST3160, codebook selecting section 318 decides whether or not the difference between the minimum coding distortion of the first channel signal and the minimum coding distortion of the second channel signal is equal to or smaller than a predetermined value. That is, when codebook selecting section 318 decides that the difference between the minimum coding distortion of the first channel signal and the minimum coding distortion of the second channel signal is equal to or smaller than the predetermined value, codebook selecting section 318 decides that the minimum coding distortion of the first channel signal is equal to the minimum coding distortion of the second channel signal. When the difference between these two minimum coding distortions is not equal to or smaller than the predetermined value, the flow returns to ST3120, and codebook selecting section 318 repeats the processings from ST3120 to ST3160 until the difference between these two minimum coding distortions becomes equal to or smaller than the predetermined value.

As described above, although the steps shown in this figure differ from initialization of the bit allocation processing shown in FIG. 9 in that the number of bits corresponding to a predetermined upper limit is equally allocated to both channels upon initialization, the number of bits corresponding to the predetermined upper limit is allocated to both channels so that, as a result of subsequent processings, the coding distortion of the first channel signal becomes equal to the coding distortion of the second channel signal as in the steps shown in FIG. 9.

In this way, according to this embodiment, the number of bits corresponding to a predetermined upper limit is adaptively allocated to both channels so that the coding distortion of the first channel signal becomes equal to the coding distortion of the second channel signal, and therefore it is possible to reduce coding distortion of the encoding apparatus and improve the coding performance of the encoding apparatus.

Although, a case has been described with this embodiment as an example where bits are allocated so that the coding distortion of the first channel signal becomes equal to the coding distortion of the second channel signal, bits may also be allocated so as to minimize the sum of the coding distortion of the first channel signal and the coding distortion of the second channel signal. The method of distributing bits so as to minimize the sum of the coding distortion of the first channel signal and the coding distortion of the second channel signal is suitable for being applied to a case where the degree of improvement in the coding distortion of one channel signal is significantly greater than the degree of improvement in the coding distortion of the other channel signal by the increase in the number of bits. In this case, more bits are allocated to the channel where coding distortion is significantly improved by increasing the number of bits. The combination of the number of bits for the first channel and the number of bits for the second channel, that minimizes the sum of the coding distortion of both channel signals is searched for by encoding combinations on a round-robin basis.

Although a case has been described with this embodiment as an example where bits are equally allocated to both channels in ST3010 and ST3110 as initialization of bit allocation processing, it is also possible to allocate more bits to the first channel than the second channel as initialization of bit allocation processing by taking into consideration that the coding distortion of the second channel signal depends on the coding distortion of the first channel signal. Furthermore, it is also possible to calculate a value of a cross correlation function between the monaural signal and the first channel signal and a value of a cross correlation function between the monaural signal and the second channel signal, and adaptively increase the number of bits allocated to the channel having the smaller value of the cross correlation function as initialization of bit allocation processing. The initialization processing improved in this way can reduce the number of loop processings required until the minimum coding distortion of the first channel signal becomes equal to the minimum coding distortion of the second channel signal and shorten the bit allocation processing.

Furthermore, although a case has been described with this embodiment as an example where a fixed codebook index is used as a target for which bit allocation is changed, a coded parameter other than the fixed codebook index may also be used as the target for which bit allocation is changed. For example, coding information such as an LPC parameter, adaptive codebook lag, excitation gain parameter, may also be adaptively changed.

Furthermore, although a case has been described with this embodiment as an example where bits are allocated based on coding distortion, bits may also be allocated based on information other than coding distortion. For example, bits may also be allocated based on a prediction gain of the excitation predicting section. Alternatively, bits may also be allocated using the value of a cross correlation function between the monaural signal and the first channel signal, the value of a cross correlation function between the monaural signal and the second channel signal, and the like. In this case, the value of a cross correlation function between the monaural signal and the first channel signal and the value of a cross correlation function between the monaural signal and the second channel signal are calculated, and more bits are allocated to the channel having the smaller value of cross correlation function. Furthermore, the number of bits to be allocated to the first channel may also be adaptively increased by taking into consideration that the coding distortion of the second channel signal depends on the coding distortion of the first channel signal.

The embodiments of the present invention have been described.

The scalable coding apparatus and the scalable coding method according to the present invention are not limited to the above-described embodiments and can be implemented by making various modifications. For example, each embodiment can be implemented in combination with other embodiments as appropriate.

Furthermore, the fixed codebook may also be referred to as a "fixed excitation codebook," "noise codebook," "stochastic codebook" or "random codebook."

Furthermore, the adaptive codebook may also be referred to as an "adaptive excitation codebook."

Furthermore, LSP may also be referred to as an "LSF" (Line Spectral Frequency) and LSP may be read as "LSF." Furthermore, instead of LSP, ISP (Immittance Spectrum Pairs) may also be encoded as spectral parameters, and the present invention can be used as an ISP coding/decoding apparatus by reading LSP as "ISP."

Furthermore, the scalable coding apparatus according to the present invention can be provided in a communication terminal apparatus and a base station apparatus in a mobile communication system, and, by this means, it is possible to provide a communication terminal apparatus, base station apparatus and mobile communication system having same operation effects as described above.

Also, although cases have been described with the above embodiment as examples where the present invention is configured by hardware. However, the present invention can also be realized by software. For example, it is possible to implement the same functions as in the base station apparatus of the present invention by describing algorithms of the scalable coding methods according to the present invention using the programming language, and executing this program with an information processing section by storing in memory.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The present application is based on Japanese Patent Application No. 2005-159685, filed on May 31, 2005, and Japanese Patent Application No. 2005-346665, filed on Nov. 30, 2005, the entire content of which is expressly incorporated by reference herein.

Industrial Applicability

The scalable coding apparatus and the scalable coding method according to the present invention can be applied to a communication terminal apparatus, base station apparatus, and the like in a mobile communication system.

The invention claimed is:

1. A scalable coding apparatus, comprising:

a monaural coder that encodes a monaural signal; and a stereo coder, distinct from said monaural coder, that includes:

a first predictor that performs prediction of an excitation of a first channel included in a stereo signal from an excitation obtained in the monaural coder, after encoding by the monaural coder;

a first channel coder that encodes the first channel using the excitation predicted by the first predictor;

a second predictor that performs prediction of an excitation of a second channel included in the stereo signal from each of the excitation obtained by the monaural coder and the excitation obtained by the first channel coder, after encoding by the first channel coder; and a second channel coder that encodes the second channel using the excitation predicted by the second predictor.

2. The scalable coding apparatus according to claim 1, wherein the second predictor predicts the excitation of the second channel by subtracting the excitation obtained through encoding by the first channel coder from twice the excitation obtained through encoding by the monaural coder.

3. The scalable coding apparatus according to claim 1, wherein the first predictor performs the prediction using at least one of a delay time difference and an amplitude ratio between the monaural signal and the first channel signal.

4. The scalable coding apparatus according to claim 1, further comprising a setter that sets a channel having a higher correlation between the excitation of the monaural signal out of channels included in the stereo signal as the first channel.

5. The scalable coding apparatus according to claim 1, further comprising a bit allocator that allocates bits to the first channel coder and the second channel coder so that a coding distortion of the first channel becomes equal to a coding distortion of the second channel.

6. The scalable coding apparatus according to claim 1, further comprising a bit previously presented allocator that allocates bits to the first channel coder and the second channel coder so as to minimize a sum of a coding distortion of the first channel and a coding distortion of the second channel.

7. The scalable coding apparatus according to claim 1, further comprising a bit allocator that allocates bits to the first channel coder and the second channel coder, wherein:

the first channel coder and the second channel coder comprise a plurality of fixed codebooks having different bit rates; and the bit allocator performs allocation of the bits by changing the fixed codebook used by the first channel coder and the second channel coder.

8. The scalable coding apparatus according to claim 1, further comprising a bit allocator that allocates bits to the first channel coder and the second channel coder, wherein the bit allocator allocates more bits to the first channel coder than the second channel coder as an initial condition for a distribution of bits.

9. The scalable coding apparatus according to claim 1, further comprising a bit allocator that allocates bits to the first channel coder and the second channel coder, wherein, as an initial condition for a distribution of bits, the allocator allocates more bits to the second channel coder than the first channel coder when the excitation of the first channel has a higher correlation with the excitation of the monaural signal than the excitation of the second channel and allocates more bits to the first channel coder than the second channel coder when the excitation of the second channel has a higher correlation with the excitation of the monaural signal than the excitation of the first channel.

10. A communication terminal apparatus comprising the scalable coding apparatus according to claim 1.

11. A base station apparatus comprising the scalable coding apparatus according to claim 1.

12. A scalable coding method, comprising:

encoding a monaural signal with a monaural coder;

encoding a stereo signal with a stereo coder that is distinct from the monaural coder, the stereo coder:

performing prediction of an excitation of a first channel included in the stereo signal from an excitation obtained in the monaural encoding, after encoding of the monaural signal;

encoding a first channel using the predicted excitation of the first channel included in the stereo signal;

performing prediction of an excitation of a second channel included in the stereo signal from each of the excitation obtained in the monaural signal encoding and the excitation obtained in the first channel encoding, after the first channel encoding; and encoding a second channel using the excitation predicted in the predicting an excitation of a second channel.

* * * * *